US005759735A

United States Patent [19]

Nakamura et al.

[11] Patent Number: 5,759,735

[45] Date of Patent: Jun. 2, 1998

[54] METHOD FOR PREPARING DEVELOPER FOR USE IN ELECTROPHOTOGRAPHIC PRINTING

[75] Inventors: Tadashi Nakamura, Nara; Kanshiro Okamoto, Yamatokoriyama; Hirofumi Sakita, Kitakatsuragi-gun; Toshihiko Murakami, Habikino; Yoshiaki Akazawa, Yamatokoriyama, all of Japan

[73] Assignee: Sharp Kabushiki Kaisha, Osaka, Japan

[21] Appl. No.: 790,385

[22] Filed: Jan. 29, 1997

Related U.S. Application Data

[63] Continuation of Ser. No. 546,348, Oct. 20, 1995, abandoned, which is a continuation of Ser. No. 317,319, Oct. 4, 1994, abandoned.

[30] Foreign Application Priority Data

Oct. 6, 1993 [JP] Japan ..... 5-250725

[51] Int. Cl.[6] ..... G03G 9/09

[52] U.S. Cl. ..... 430/137; 574/495

[58] Field of Search ..... 430/137, 106; 524/495

[56] References Cited

U.S. PATENT DOCUMENTS

| | | | |
|---|---|---|---|
| 3,602,437 | 8/1971 | Driscoll | 241/5 |
| 3,862,056 | 1/1975 | Hartman | 252/511 |
| 3,959,008 | 5/1976 | Warner et al. | 106/307 |
| 3,980,575 | 9/1976 | DeRoo et al. | 430/106 |
| 4,481,329 | 11/1984 | Ambler et al. | 524/501 |
| 4,699,819 | 10/1987 | Ide et al. | 428/141 |
| 4,894,308 | 1/1990 | Mahabadi | 430/137 |
| 5,002,892 | 3/1991 | Murphy, Jr. | 436/51 |
| 5,262,268 | 11/1993 | Bertrand | 430/137 |
| 5,314,773 | 5/1994 | Kubo et al. | 430/106 |

FOREIGN PATENT DOCUMENTS

| | | |
|---|---|---|
| 51-082 626 | 7/1976 | Japan . |
| 61-050 624 | 3/1986 | Japan . |
| 61-099 155 | 5/1986 | Japan . |
| 2-153 361 | 6/1990 | Japan . |
| 4-156 554 | 5/1992 | Japan . |
| 4-269 765 | 9/1992 | Japan . |

OTHER PUBLICATIONS

Diamond, Arthur S., editor. Handbook of Imaging Materials. New York: Marcel–Dekker, Inc. p. 168, 1991.

Derwent WPI Abstract, Accession No. 76–67635X, week 7636, abstracting JP–A–51–082 626 and JP–B–56–016 421, Ricoh.

*Primary Examiner*—Christopher D. Rodee

*Attorney, Agent, or Firm*—David G. Conlin; Milton Oliver; Robert L. Buchanan

[57] ABSTRACT

A method for preparing an electrophotographic printing-use developer by mixing components of toner material, fusing and kneading the toner material, and then crushing and classifying the toner material, includes the step of arranging carbon black which is one of the components of the toner material to contain water before the mixing step. This arrangement permits even dispersion of water in the mixture of the components, prevents the flowability of the mixture from being lowered, and achieves stable kneading. Therefore, improved dispersion of the components is achieved. Since water adsorption is stable, water-treated carbon showing reduced water segregation is obtained. Consequently, high quality less foggy images with high resolution are obtained.

3 Claims, 3 Drawing Sheets

METHOD FOR PREPARING DEVELOPER FOR USE IN ELECTROPHOTOGRAPHIC PRINTING

This application is a continuation of application Ser. No. 08/546,348 filed on 20 Oct., 1995, now abandoned, which is a continuation of application Ser. No. 08/317,319 filed on 4 Oct., 1994, now abandoned.

FIELD OF THE INVENTION

The present invention relates to a method for preparing an electrophotographic printing-use developer such as two-component toner and single-component toner used in an electrophotographic apparatus, for example, a copying machine.

BACKGROUND OF THE INVENTION

In order to obtain high-quality, less foggy images with high resolution, the electrophotographic printing-use developer needs to improve the dispersion of components of toner material such as a coloring agent, a charge control agent, and of an offset preventing agent in a binding resin as a principal material of toner. The dispersion depends largely on the viscosity of the mixture of the above agents and the binding agent in fusing and kneading.

Specifically, when the temperature of the toner material rises due to the heat generated by shearing forces in fusing and kneading, the viscosity is lowered with a rise of the temperatures. Consequently, the toner material fails to receive sufficient shearing forces, and thereby resulting in unsatisfactory kneading.

In order to overcome such a problem, for example, Japanese Publication for Unexamined Patent Application No. 50624/1986 discloses a method for injecting a liquid into the toner material in the fusing and kneading process. FIG. 3(*a*) schematically illustrates an overall structure of a machine for preparing an electrophotographic printing-use developer. With the machine, a binding agent and predetermined amounts of components of toner material such as coloring, charge control and offset preventing agents are introduced into a material mixer 21, and mixed therein. The mixed toner material is supplied to a material supply device 23 through a pipe 22 and then to a kneader 25 through a pipe 24. In the kneader 25, the toner material is fused and kneaded. The resulting toner material is discharged onto a cooling conveyer 26 from the kneader 25, and then coarsely crushed by a crusher 27.

According to the method disclosed by the above-mentioned publication, in the processes of preparing the electrophotographic processing-use developer, fusing and kneading are carried out while injecting a liquid into the kneader 25 from a pump 29 through a spray nozzle 28. More specifically, as illustrated in FIG. 3(*b*), components of toner material 31 are sent through a mixing step 32 to a kneading step 33 in which water 34 as a liquid is added, and fusing and kneading are performed.

In this case, the temperature of the toner material is lowered since the added liquid component vaporizes by taking the heat of vaporization from the toner material and the pressure in the kneader 25 is lowered as an aspirator aspirates the vapor generated. Since the viscosity of the toner material is increased with a decrease in the temperature, the shearing forces to be applied by the kneader 25 effectively works on the toner material. As a result, satisfactory kneading is performed and the dispersion of the components of toner material in the binding resin is improved.

With this method, however, the fusion start position of the binding resin in the kneader 25 varies with changes in the kneading conditions, such as the type of binding resin to be kneaded, lot, the amount of toner material supplied, and the rotation speed of screws and rotors in the kneader 25. Therefore, when the liquid is injected from the fixed position, injection is not performed at the proper position. Moreover, when kneading toner material including a highly abrasive component such as magnetic powder, the spray nozzle 28 which is the means for injecting the liquid is abraded by the kneaded material, and its function is impaired, resulting in deficient injection.

In order to overcome such a problem, Japanese Publication for Unexamined Patent Application No. 269765/1992, TOMONAGA discloses a method for injecting a liquid when mixing components of toner material. Namely, as illustrated in FIG. 4(*a*), this publication teaches a machine in which a liquid is injected into a mixer 41 from a pump 49 through a spray nozzle 48. Like in the above-mentioned machine, in this machine, the components of toner material mixed in the mixer 41 are sent to a material supply device 43 through a pipe 42 and further to a kneader 45 through a pipe 44 for kneading, discharged onto a cooling conveyer 46, and coarsely crushed by a coarse crusher 47.

More specifically, as illustrated in FIG. 4(*b*), the method for preparing an electrophotographic printing-use developer disclosed in this publication arranges toner material to contain water by supplying water 53 when mixing the components of toner material 51 in a mixing step 52, and sends the water-containing toner material to a kneading step 54 to perform fusing and kneading therein. This arrangement solves the above-mentioned problems related to fusing and kneading in the kneader 25.

However, with the method disclosed by Japanese Publication for Unexamined Patent Application No. 269765/1992, TOMONAGA the nozzle 48 in the mixer 41 is easily clogged with components of toner material, especially, with fine components such as carbon black. It is therefore difficult to stably obtain an electrophotographic printing-use developer achieving satisfactory dispersion of the components of toner material.

Additionally, with this method, when water is injected into the mixture of the components of toner material, the flowability of the mixture is lowered by mutual functions between the water and the binding resin in the mixture. Therefore, in the step of introducing the toner material into the supply device 43 through the hopper opening of the pipe 42, the toner material adheres to the hopper opening, thereby preventing constant supply of the toner material. Furthermore, when water and the components of toner material are segregated in the mixture, water vapor occurs locally during kneading. This causes the toner material to flow backwards, resulting in unstable kneading. Such disadvantages prevent a stable preparation of a developer with satisfactory dispersion.

SUMMARY OF THE INVENTION

An object of the present invention is to provide a method for preparing an electrophotographic printing-use developer capable of producing high quality, less foggy images with high resolution.

In order to achieve the above object, a method for preparing an electrophotographic printing-use developer according to the present invention including the step of mixing components of toner material for the electrophotographic printing-use developer, a fusing and kneading step, and a crushing step, and a classifying step, is characterized in including the step of arranging carbon black which is one of the components of the toner material to contain water before the mixing step.

With this method, since the carbon black which has a relatively small particle diameter, i.e., a large specific surface area among the components of the toner material is prearranged to contain water before being mixed with other components of the toner material, water is dispersed evenly in the mixture in mixing and a lowering of the flowability of the mixture due to mutual functions between a binding resin and water is prevented. Additionally, since water segregation can hardly occur, the temperature of the toner material is evenly lowered by the heat of water vaporization, and the viscosity of the toner material is maintained at a sufficient level. As a result, satisfactory kneading is achieved, and the dispersion of the components of toner material is improved. It is thus possible to obtain high quality less foggy images with high resolution.

When the water content of the carbon black is 3 to 10%, the above-mentioned effects are enhanced.

Another method for preparing an electrophotographic printing-use developer of the present invention is characterized in including the step of arranging the carbon black to contain an alcohol before the step of arranging the carbon black to contain water.

With this method, since the affinity between the water and carbon black is increased by arranging the carbon black to contain the alcohol, water is more stably adsorbed by the carbon black, thereby achieving water-treated carbon with reduced water segregation. It is thus possible to further improve the quality of images by reducing fog and increasing the resolution.

For a fuller understanding of the nature and advantages of the invention, reference should be made to the ensuing detailed description taken in conjunction with the accompanying drawings.

DETAILED DESCRIPTION OF THE PREFERRED EMBODIMENTS

[EMBODIMENT 1]

Figure 1:
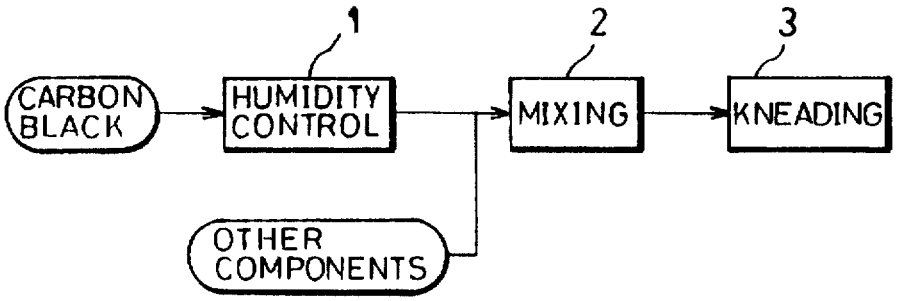
FIG. 1 illustrates a block diagram of essential processes to explain a method for preparing an electrophotographic printing-use developer according to one embodiment of the present invention.

The following description discusses one embodiment of the present invention with reference to FIG. 1.

Table 1 shows components of toner material and a mixing ratio employed to prepare toner as an electrophotographic printing-use developer for use in a copying machine.

TABLE 1

| Components of toner material | Mixing ratio | Manufacturers |
|---|---|---|
| Styrene/butyl acrylate copolymer | 100 parts by weight | |
| Carbon Black Monarch 880 | 6 parts by weight | Cabot Corporation |
| BONTRON P-51 | 2 parts by weight | Orient Chemical Industries, Ltd. |
| HI-WAX NP505 | 1.5 parts by weight | Mitsui Petrochemical Industries, Ltd. |
| PE 130P | 1 part by weight | Hoechst Aktiengesellschaft |

As shown in Table 1, copolymer of styrene and butyl acrylate was used as a binding resin, and carbon black BONTRON P-51, HI-WAX NP 505, and PE 130P were mixed with the binding resin at the mixing ratio indicated in Table 1. In this embodiment, as illustrated in FIG. 1, before mixing the components of toner material, pre-treatment of carbon black as one of the components of toner material was carried out by keeping it in a predetermined humidity condition in a humidity control step 1.

This treatment was carried out by leaving 3 Kg of carbon black in an air-conditioned vessel having a temperature of 20° C. and a relative humidity of 80% for 24 hours. The carbon black removed from the air-conditioned vessel contained 5.8% of water and its specific surface area was 220 $m^2/g$.

After the pre-treatment of carbon black, amounts of the carbon black and other components proportional to 50 Kg of styrene/butyl acrylate copolymer were measured according to the ratio indicated in Table 1. Then, in a manner similar to the conventional manner, they were mixed together by Henschel mixer in a mixing step 2, and fused and kneaded in a kneading step 3. Thereafter, although not shown in the drawings, the resulting material was crushed and classified like in the conventional manner to prepare toner for use in a copying machine.

The discharge temperature of the kneaded material in the fusing and kneading operations of this embodiment was 160° C. and an average particle diameter of the kneaded material crushed by a jet mill was 9.5μm. When dispersed state of the carbon black of toner was observed by a microscope (TEM), a favorable dispersed state without secondary aggregation was observed. Then, the toner was dissolved in tetrahydrofuran (THF) of a predetermined concentration, and the absorbency thereof was measured with an ultra-violet spectrophotometer of 400 nm. The absorbency was 1.75. Subsequently, 4 parts by weight of the toner and 96 parts by weight of carrier were mixed, and a copy was produced by a copying machine, SD2060 from Sharp. The image density (ID) was 1.45 and the fog of the image (BG) was 0.5. Namely, the results of the image quality test were satisfactory.

Additionally, various experiments were carried out by changing the relative humidity in the air-conditioned vessel for pre-treatment of the carbon black. The results are shown in Table 2.

TABLE 2

| RELATIVE HUMIDITY | ABSOR-BENCY | ID | BG | WATER CONT. OF CARBON BLACK | JUDGEMENT |
|---|---|---|---|---|---|
| 20% | 1.34 | 1.33 | 2.0 | 1% | UNSATISFAC-TORY, HIGH BG |
| 40% | 1.50 | 1.40 | 1.5 | 3% | SLIGHTLY UNSATISFAC-TORY, LITTLE HIGH BG |
| 60% | 1.70 | 1.44 | 0.8 | 5% | SATISFAC-TORY |
| 80% | 1.75 | 1.45 | 0.5 | 5.8% | SATISFAC-TORY |
| 90% | 1.65 | 1.41 | 0.8 | 8% | SATISFAC-TORY |

According to Table 2, when the carbon black contained 3 to 8%, more favorably, 5 to 8% of water, satisfactory copies of images were obtained.

[EMBODIMENT 2]

Figure 2:
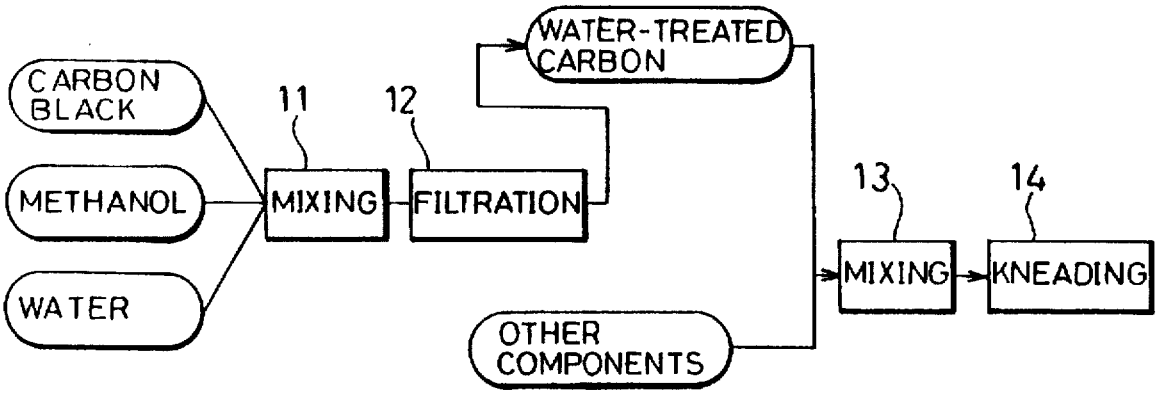
FIG. 2 illustrates a block diagram of essential processes to explain a method for preparing an electrophotographic printing-use developer according to another embodiment of the present invention.
Figure 3:
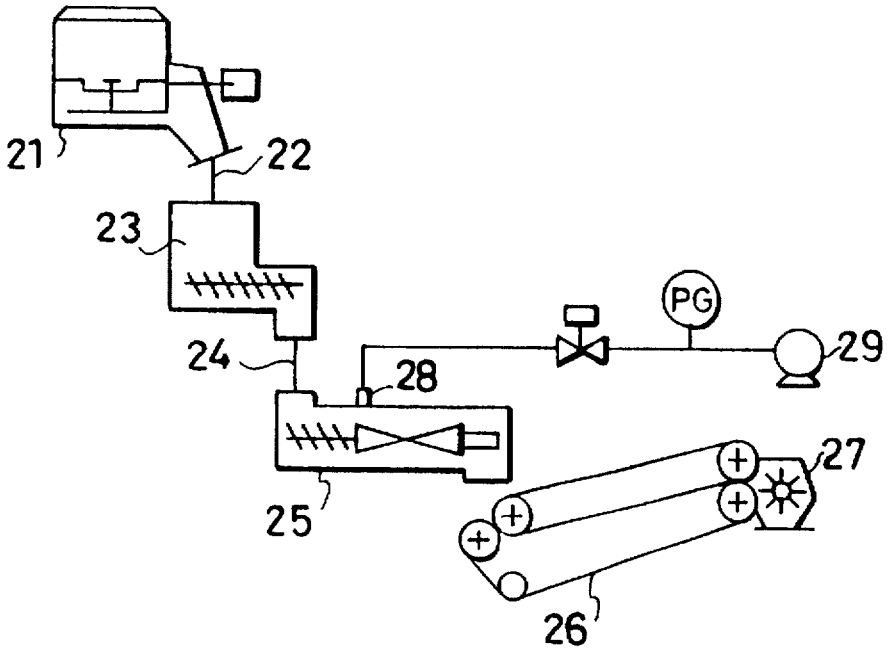
FIGS. 3(*a*) and 3(*b*) illustrate conventional processes of preparing an electrophotographic printing-use developer, wherein FIG. 3(*a*) is an explanatory view showing the entire processes, and FIG. 3(*b*) is a block diagram showing essential processes.
Figure 3:
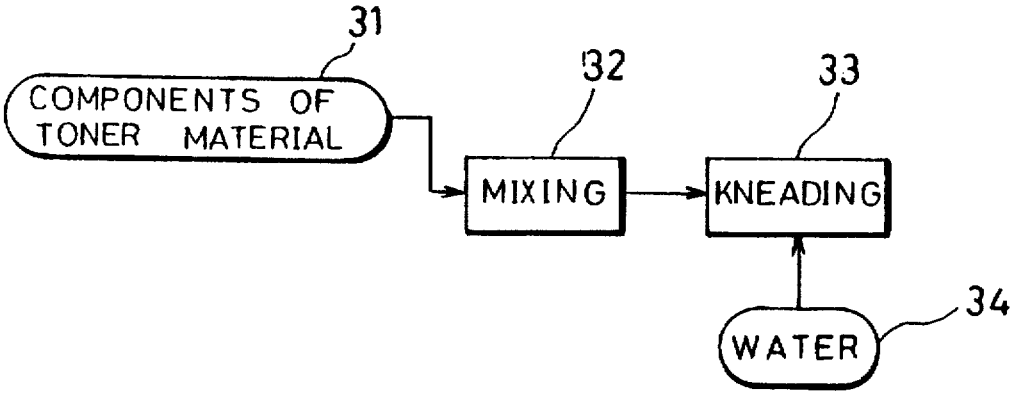
Figure 4:
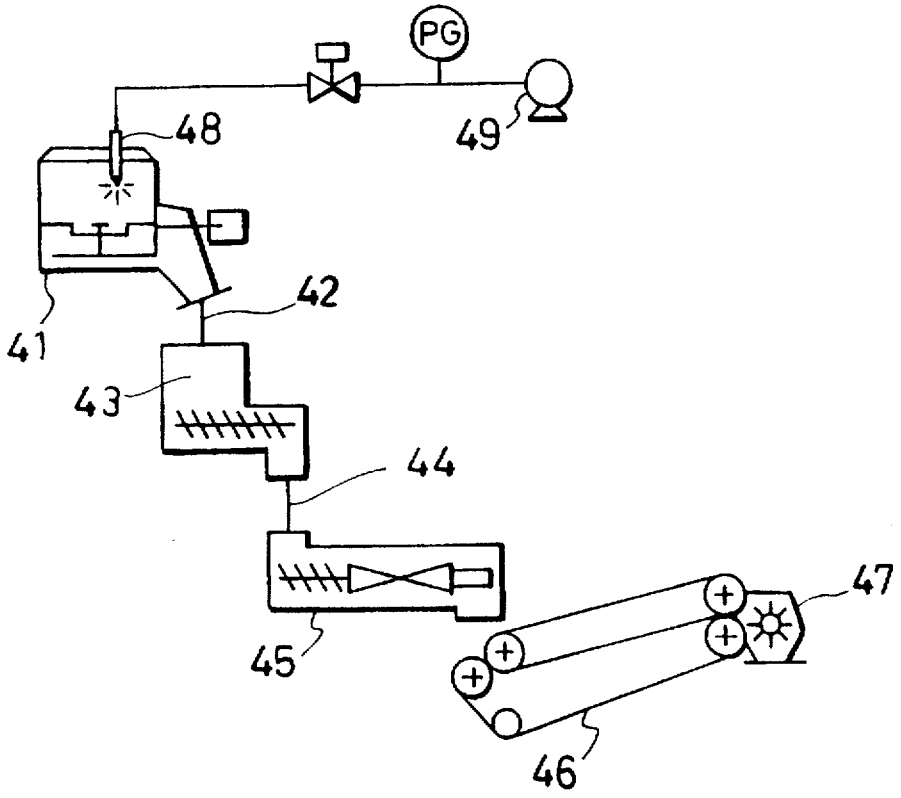
FIGS. 4(*a*) and 4(*b*) illustrate another conventional processes of preparing an electrophotographic printing-use developer, wherein FIG. 4(*a*) is an explanatory view showing the entire processes, and FIG. 4(*b*) is a block diagram showing essential processes.
Figure 4:
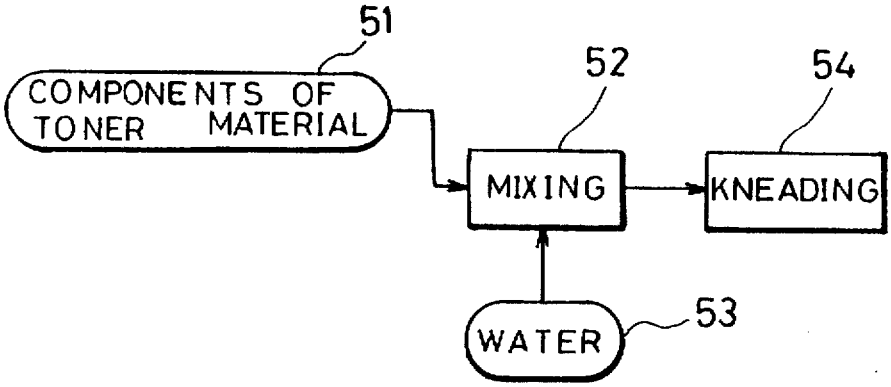

The following description discusses another embodiment of the present invention with reference to FIG. 2.

In this embodiment, as illustrated in FIG. 2, the pretreatment of the carbon black was carried out through a mixing step 11 in which methanol and water were successively added and mixed with the carbon black and a filtering step 12. More specifically, 30 ml of methanol was added and mixed with 3 Kg of carbon black similar to that used in Embodiment 1. Then, additional 3 Kg (3000 ml) of water was added to obtain a slurry state, and mixed. Subsequently, the mixture was naturally filtered with Nutsche, and the carbon black remaining on the filter paper was collected. The water content of the carbon black was 10%.

The carbon black thus obtained was mixed with the other components according to the mixing ratio shown in Table 1 of Embodiment 1 in a mixing step 13, and fused and kneaded in a kneading step 14 as illustrated in FIG. 2. The resulting material was crushed and classified to prepare toner for use in a copying machine.

The discharging temperature of the kneaded material in fusing and kneading was 155° C., the absorbency was 1.70, ID was 1.40, and BG was 0.7.

Thus, by arranging in advance the carbon black to contain water, more favorable copy quality was obtained even when carbon black containing 10% of water was used.

[COMPARATIVE EXAMPLE]

Components of toner material similar to those used in Embodiment 1 were used, and mixing was performed while adding 0.6% of water into a mixture of the components of the toner material. Since the flowability of the mixture was insufficient, the mixture could not be supplied to a kneader in a satisfactory manner. The dispersion of the carbon black in the toner thus prepared was not as satisfactory as that achieved in Embodiment 1, and much secondary aggregation was observed. According to the results of examining copies, BG was 2.0 and thus the copies of images had unsatisfactory quality.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of preparing an electrophotographic printing-use developer comprising the steps of:

mixing carbon black with an alcohol to form a first mixture;

adding water to said first mixture to form an intermediate mixture;

filtering said intermediate mixture to collect the carbon black as a residue having a water content of 3 to 10 percent;

mixing said carbon black residue with a charge control agent, an offset preventing agent and a binding resin, thereby forming a toner material;

fusing and kneading the toner material;

crushing the toner material which has been fused and kneaded; and classifying the toner material.

2. The method of preparing an electrophotographic printing-use developer according to claim 1, wherein the alcohol is methanol.

3. The method of preparing an electrophotographic printing-use developer according to claim 1, wherein the carbon black residue has a water content of 10 percent.

* * * * *